US005161270A

United States Patent [19]

Najmabadi

[11] Patent Number: 5,161,270

[45] Date of Patent: Nov. 10, 1992

[54] CHANGING APPARATUS

[76] Inventor: Feridoon Najmabadi, 3000 S. Wells, Apt. 1R, Chicago, Ill. 60616

[21] Appl. No.: 667,540

[22] Filed: Mar. 11, 1991

[51] Int. Cl.[5] ..... A47D 15/00

[52] U.S. Cl. ..... 5/424; 5/513; 128/869

[58] Field of Search ..... 5/93.1, 99.1, 100, 424, 5/513; 128/869, 870, 872; 269/328

[56] References Cited

U.S. PATENT DOCUMENTS 3,721,434 3/1973 Spies ..... 5/424 X
3,968,911 7/1976 Haas ..... 5/424 X
4,133,063 1/1979 Jones-Steele ..... 5/99.1
4,178,926 12/1979 Cohn ..... 5/513 X
4,205,669 6/1980 Hamann ..... 5/424 X
4,712,258 12/1987 Eves ..... 5/424
4,999,863 3/1991 Kane ..... 5/99.1 X

*Primary Examiner*—Michael F. Trettel

[57] ABSTRACT

This invention relates to a changing apparatus comprising mattress means for receiving a person including an upper portion and a lower portion; and means for separating said upper portion and said lower portion operatively connected to said mattress means, said separator means including an open position for allowing a person to be positioned on said mattress means and a closed position for substantially preventing said person from touching his or her lower extremities.

13 Claims, 1 Drawing Sheet

CHANGING APPARATUS

FIELD OF THE INVENTION

This invention relates to a changing apparatus comprising mattress means for receiving a person, including an upper portion and a lower portion; and means for separating said upper portion and said lower portion operatively connected to said mattress means, said separator means including an open position for allowing a person to be positioned on said mattress-means and a closed position for substantially minimizing the possibility of such person from touching his or her lower extremities.

BACKGROUND OF THE INVENTION

The present invention relates to a device on which a persons diaper can be easily, sanitarily, safely and conveniently changed.

Typifying many prior art accessories relating to changing devices are found in U.S. Pat. Nos. 4,712,258; 3,659,297; 2,846,700; 4,606,087; 4,216,951; 4,522,381; 3,013,555; and 3,489,194.

It is therefore desirable that a low-cost and effective diaper changing apparatus be available, which is sanitary and substantially minimizes the possibility of the person whose diaper is being changed from touching his or her waste or excretions during the diaper changing procedure.

It is therefore an object of this invention to provide a changing apparatus to allow a person freedom to change a diaper, while providing freedom of hand movement.

It is also an object of this invention to provide a changing apparatus which is sanitary by substantially preventing a person such as a baby from touching his or her lower extremities.

SUMMARY OF THE INVENTION

A changing apparatus comprising: mattress means for receiving a person, including an upper portion and a lower portion; and means for separating said upper portion and said lower portion operatively connected to said mattress means, said separator means including an open position for allowing a person to be positioned on said mattress means and a closed position for substantially minimizing the possibility of said person from touching his or her lower extremities.

A changing apparatus comprising: mattress means for receiving a person, including an upper portion and a lower portion; and means for separating said upper portion and said lower portion hingeably connected to said mattress means and substantially perpendicular thereto, said separator means including an open position adapted to allowing a person to be positioned on said mattress means and a closed position for substantially minimizing the possibility of said person from touching his or her lower extremities.

DETAILED DESCRIPTION OF THE PREFERRED EMBODIMENT

While this invention is susceptible of embodiments in many forms, there are shown in FIGS. 1–8, two embodiments suitable for use in the practice of this invention, with the understanding that the present disclosure is not intended to limit the invention to the embodiments illustrated.

Figure 1:
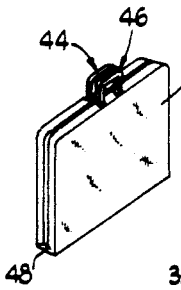
FIG. 1 is a perspective view of a changing apparatus in accordance with principles of the present invention.
Figure 2:
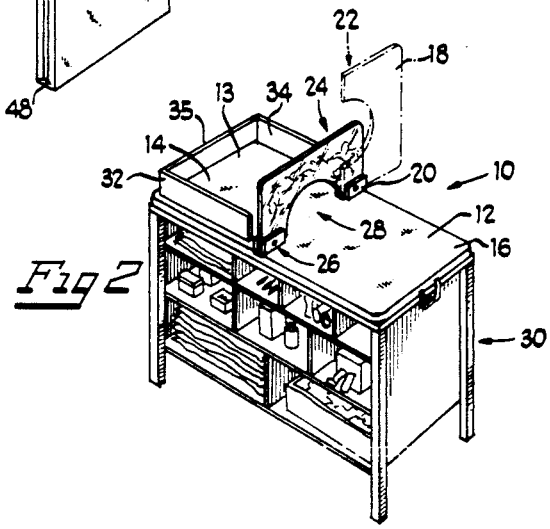
FIG. 2 is an enlarged perspective view of the changing apparatus in accordance with principles of the present invention.
Figure 4:
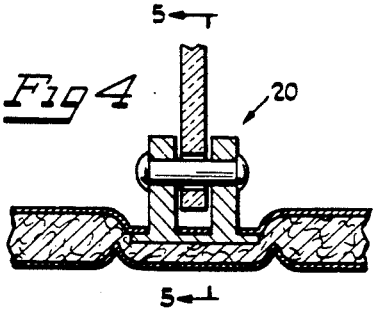
FIG. 4 is an enlarged view taken at the 4—4 line of FIG. 3 in accordance with principles of the present invention.

Illustrated in FIGS. 1 and 2, is a portable changing table or apparatus 10, including a mattress means 12 for receiving a person, having an upper portion 14 and a lower portion 16 and means for separating 18 said upper portion 14 and said lower portion 16 operatively connected to said mattress means 12, said separator means 18 including an open position 22 for allowing a person or animal to be positioned on said mattress means 12 and a closed position 24 for minimizing the possibility of such person or animal from touching his/her or its lower extremities. More particularly, the mattress means 12 is a substantially flat, platform or grooved for receiving a person, such as a baby. Preferably, the mattress is made of a soft or comfortable material, such as but not limited, to rubber, thin padded plastics, and the like, while also being resilient and washable.

The mattress means 12 is configured with round edges 13 for minimizing the possibility of scratching a person. Referring to FIG. 1, an outer side 11 opposite the inside, upper and lower portion 14 and 16, includes pockets or pouches adapted to receiving accessories such as wipes, diapers, baby powder, etc. Referring to FIG. 2, the upper portion 14 is adapted to receiving the upper abdomen of a person or baby to be changed, and preferably includes a pillow for support and comfort. The lower portion 16 is adapted to receiving the lower portion below a person's abdomen for enhanced access for diaper changing.

The separator means 18 or dividing means, can be made of any material, which is strong and rigid, preferably a clear material such as but not limited to plexiglas, glass, polymers and fire resistant polymers. Alternatively, the separator means 18 can include cartoon characters, pictures and the like, to entertain a child being changed on the changing apparatus 10. The separator means 18 is intended to substantially prevent a person being changed, such as a child, or animal from touching his, her or its lower abdomen or excretions for sanitary purposes. The separator means 18 can be enlarged and reinforced, for use in connection with an adolescent or adult needing a diaper change. The separator means 18 provides freedom of hand movement for the person changing a diaper for a short period of time.

Figure 5:
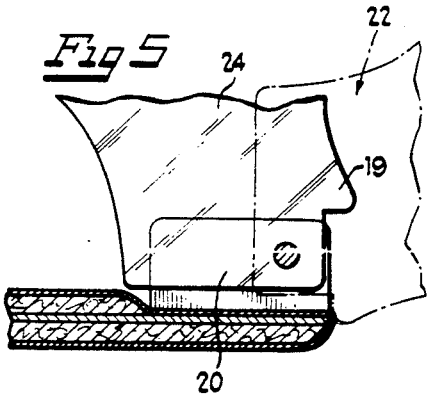
FIG. 5 is an enlarged view taken at the 5—5 line of FIG. 4 in accordance with principles of the present invention.

The separator means 18 includes a lip 19 as illustrated in FIG. 5 to hold the separator means 18 in the open position. A pivot means or hinge 20 allows the separator means 18 to be opened and closed or move in a direction away from and toward the mattress means 12, respectively. Illustrated in phantom in FIG. 2, is the separator means 18 in the open position 22 and in FIGS. 2 and 3, the separator means 18 is illustrated in a closed position. Opposite the hinge 20 of the separator means 18, is the connecting means 26 or locking means, which is utilized to connect or lock the separator means 18 to the mattress means 12. A port area 28 or opening allows a person to lie adjacent to the mattress means 12 and between the mattress means 12 and separator means 18. The port area 28 can include any geometry or configuration which will allow a person or animal to lie preferably back down on the mattress means 12. Preferably, a semicircle or square port 28 is utilized for ease of opening and closing. Under the changing apparatus 10, is a changing table 30. In an alternate embodiment, the changing apparatus 10, can be positioned substantially on a bed, when used for adults or children. In a preferred embodiment, the mattress 12 is securely fastened or attached to the changing table 30 or bed.

The upper portion 14 is configured to include first and second sideboards 32 and 34 and headboard 35 extending away from and perpendicular to the mattress 12.

Figure 3:
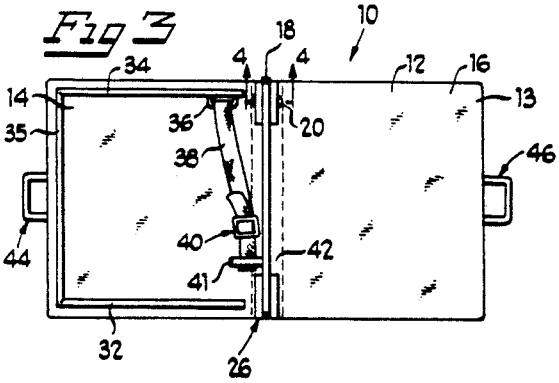
FIG. 3 is an enlarged top view of the changing apparatus in accordance with principles of the present invention.
Figure 8:
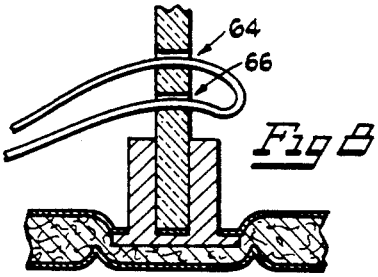
FIG. 8 is an enlarged partial cross-sectional view of the changing apparatus of FIG. 7.

An attaching means 36 extends outwardly from upper portion 14. A securing means 38 is attached to attaching means 36. The securing means 38 can include a soft or padded conventional belt, made of a washable material. The securing means 38 can include adjustment means, such as a buckle or a hook and loop type fastener such as the one sold under the trademark Velcro for adjusting the securing means 38. The securing means 38 can include a self-adjusting, and self-locking and/or retractable belt. An attachment means 41, is attached to the separator means 18. In normal use, the securing means 38 helps to secure a person in and on the mattress means 12 when the separator means 18 is closed. When the separator means 18 is closed, the securing means 38 helps to securely hold the person on mattress 12 and between separator means 18 and the mattress 18. The separator means 18, can be positioned anywhere on mattress means 12, preferably in a substantially middle portion 42, in phantom, as illustrated in FIG. 3. Referring to FIG. 1, for ease of carrying, a pair of handles 44 and 46 are included to help transport the changing apparatus 10. In a preferred embodiment, the changing apparatus 10 is portable and lightweight, and is flexible and/or soft with a padding material.

The sideboards 32 and 34 are adjustable and substantially perpendicular to the mattress means 12 and the separator means 18 for enhanced alignment of the person on the mattress.

The separator 18 is hingeably, pivotably or slideably connected to the mattress means to facilitate the opening 22 and closing 24 thereof.

Figure 6:
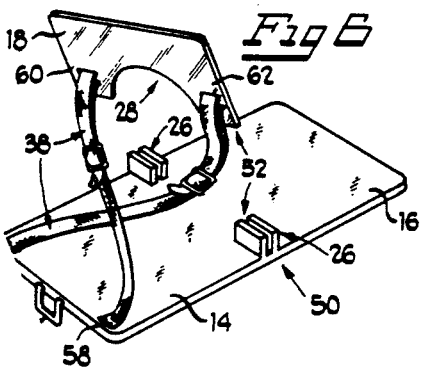
FIG. 6 is a perspective view in accordance with principles of the present invention.
Figure 7:
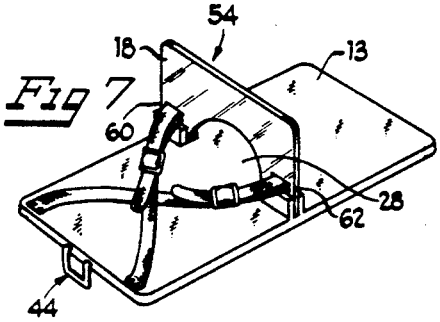
FIG. 7 is a perspective view of an alternate embodiment of the changing apparatus in accordance with the principles of the present invention.

Referring to FIG. 6, is an alternate embodiment of the changing apparatus 50. In this embodiment, the separator 18 is slideably connected to the mattress 12. In FIG. 6, the separator 18 is illustrated in an open position 52, and in FIG. 7 a closed position 54. The changing apparatus 50 of FIG. 7, includes corner areas 56 and 58 of mattress means 12 and a first area and second area 60 and 62 of separator means 16, which are configured and adapted to receive securing means 38, which when closed substantially securely holds a person on changing apparatus 50 as illustrated in FIG. 7. The separator means 18 can include opening 64 and 66, for allowing the securing means 38 to be attached thereto.

Although specific embodiments of this invention have been shown and described, it is to be understood that various modifications and substitutions, as well as rearrangements and combinations of the preceding embodiments, can be made by those skilled in the art without departing from the novel spirit and scope of this invention.

I claim:

1. A changing apparatus comprising:

(a) mattress means for receiving a person, including an upper portion and a lower portion;

(b) means for separating said upper portion and said lower portion operatively connected to said mattress means, said separator means including an open position for allowing a person to be positioned on said mattress means and a closed position for substantially minimizing the possibility of said person from touching said persons' lower extremities; and (c) securing means for securing said person on said mattress means and between said separator means and said mattress means comprising a belt being attached to said mattress means and said separator means.

2. The changing apparatus of claim 1 wherein said mattress means comprises a flexible and/or soft padding.

3. The changing apparatus of claim 1, further comprising handles attached to said mattress means.

4. The changing apparatus of claim 1, further comprising a changing table, said changing apparatus being positioned substantially on and fixed to said changing table.

5. The apparatus of claim 1, wherein said upper portion of said mattress means includes sideboards extending outwardly therefrom.

6. The apparatus of claim 5, wherein said sideboards are adjustably attached to said mattress means.

7. The apparatus of claim 1, where said separator means is hingeably connected to said mattress means.

8. The apparatus of claim 1, wherein said separator means includes connecting means for securely connecting said separator means to said mattress means.

9. A changing apparatus comprising:

(a) mattress means for receiving a person including an upper portion and a lower portion;

(b) means for separating said upper portion and said lower portion pivotably connected to said mattress means, said separator means including an open position adapted to allowing a person to be positioned on said mattress means and a closed position for substantially minimizing the possibility of said person from touching his or her lower extremities; and (c) securing means for securing said person on said mattress means and between said separator means and said mattress means comprising a belt being attached to said mattress means and said separator means.

10. The apparatus of claim 9, wherein said upper portion of said mattress means includes sideboards extending therefrom.

11. The apparatus of claim 9 further comprising handles attached to said mattress means.

12. The apparatus of claim 9, wherein said securing means is a padded belt.

13. A changing apparatus comprising:

(a) mattress means for receiving a person including an upper portion and a lower portion;

(b) means for separating said upper portion and said lower portion slideably connected to said mattress means, said separator means including an open position adapted to allowing a person to be positioned on said mattress means and a closed position for substantially securing a person on said mattress means; and (c) securing means for securing said person on said mattress means and between said separator means and said mattress means comprising a belt being attached to said mattress means and said separator means.

* * * * *